US005951415A

United States Patent [19]

Gates et al.

[11] Patent Number: 5,951,415

[45] Date of Patent: Sep. 14, 1999

[54] PORTABLE SPORTS GOAL AND METHOD OF ASSEMBLY

[76] Inventors: James R. Gates, 18382 Jocotal Ave., Villa Park, Calif. 92861; David W. Buckett, 10492 Center Dr., Villa Park, Calif. 92861

[21] Appl. No.: 09/036,657

[22] Filed: Mar. 6, 1998

[51] Int. Cl.[6] ..... A63B 63/00

[52] U.S. Cl. ..... 473/478

[58] Field of Search ..... 473/476, 478, 473/490, 492, 493, 494

[56] References Cited

U.S. PATENT DOCUMENTS

| | | | |
|---|---|---|---|
| 331,756 | 12/1885 | Baker | 473/478 |
| 4,415,163 | 11/1983 | Schoenig | 473/492 |
| 4,420,158 | 12/1983 | Klock et al. | 473/478 |
| 4,664,384 | 5/1987 | Solla | 473/478 |
| 4,720,112 | 1/1988 | Stettner et al. | 473/492 |
| 5,048,844 | 9/1991 | Haseltine | 473/478 X |
| 5,080,375 | 1/1992 | Moosavi | 473/478 |
| 5,180,143 | 1/1993 | Brower | 473/490 X |
| 5,326,109 | 7/1994 | Robl | 473/492 |
| 5,344,157 | 9/1994 | McCord | 473/492 |
| 5,476,266 | 12/1995 | Caruso | 473/478 |
| 5,695,195 | 12/1997 | John et al. | 473/478 X |

*Primary Examiner*—Raleigh W. Chiu
*Attorney, Agent, or Firm*—Stetina Brunda Garred & Brucker

[57] ABSTRACT

In accordance with the present invention, there is provided a portable sports goal which is readily assembled and disassembled for use on a playing field. The sports goal is provided with a pair of pole stakes having respective support collars. The sports goal is further provided with a pair of goal poles which have respective first and second ends. The first ends of the goal poles have respective hollow inner portions which are sized and configured to receive a respective support collar of the poles stakes. The sports goal is further provided with a pair of line stakes and a pair of pole lines which are connectable between the respective line stakes and the second ends of the goal poles, for supporting the goal poles. The sports goal is further provided with an elastic cross-bar member which is attachable to the second ends of the goal poles. The pole stakes act to laterally support the goal poles in a vertical position when the goal poles are engaged with the support collars and the pole stakes are vertically driven into the playing field.

20 Claims, 3 Drawing Sheets

Fig. 1
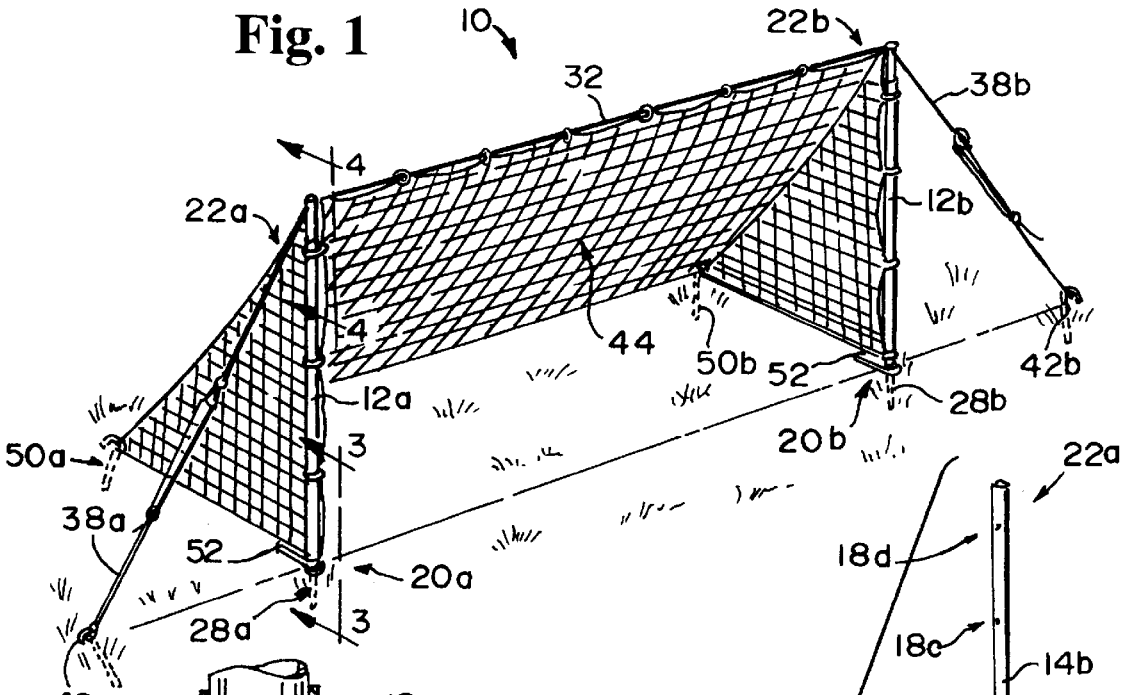
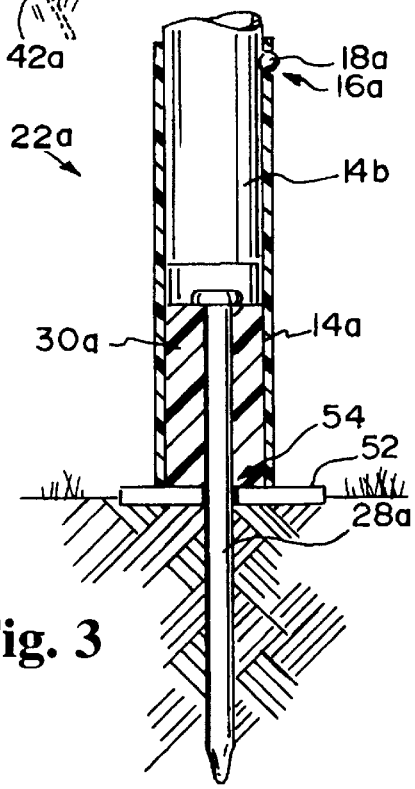
Fig. 3
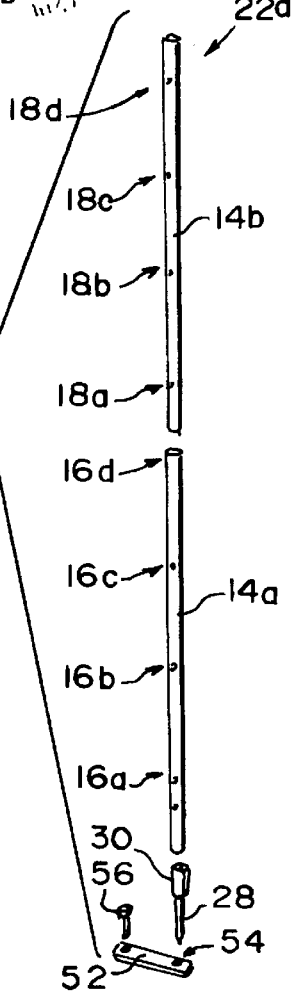
Fig. 2

PORTABLE SPORTS GOAL AND METHOD OF ASSEMBLY

FIELD OF THE INVENTION

The present invention relates generally to portable sports goals, and more particularly to a portable sports goal having a pair of collapsible goal poles which are supported via a pair of pole lines and are connected by an elastic cross-bar member.

BACKGROUND OF THE INVENTION

The present invention relates to sports goals, such as those used in the game of soccer. As the popularity of such games increases, the demand for the sports goals and playing fields also increases. Even where goals with their associated playing fields are provided, there is an additional demand for practice goals which do not require an entire playing field. As such, there is a need for temporary goals which may be taken to any suitable play/practice area for use.

A sports goal, such as those used in the game of soccer, requires a pair of vertical goal poles which define the goal width, and a horizontal cross-bar member which connects the tops of the goal poles and defines the goal height. Thus, the goal poles, the cross-bar member and the playing field itself collectively define a rectangular area which represents the goal. In addition, a sports goal is preferably equipped with a net which is attached to the goal poles and the cross-bar member for catching any sports balls shot through the goal.

In practice, the goal poles experience repeated lateral force impacts which are perpendicular to the axis defined by the goal poles, i.e., perpendicular to the goal line. For example, these force impacts occur when a soccer ball hits the goal poles, the cross-bar member, the poles lines or the net. These force impacts undesirable tend to displace the goal poles from their vertical alignment.

Prior art designs have attempted to address the vertical goal pole problem. These prior art designs, however, are usually not very portable or are difficult or complex to assemble and disassemble. For example, some designs use rigid support members to vertically stabilize the goal poles. In addition, typical prior art designs use a rigid cross-bar member which is fixed at a right angle to the goal poles to further support the goal poles. Because of the number of structural elements and the materials used, these prior art designs tend to be relatively large, heavy and bulky, and therefore not especially portable.

In addition, it is desirable that the sports goal be anchored to the playing field in some manner so that it is not displace from its desired position during use. Many of the prior art designs do not facilitate such anchoring while being arguably portable in nature. For example, some prior art designs are anchored by their own weight, which may be designed to have excessive weights added to the bottom portions of the goal poles.

Further, its is desirable that the sports goal be adjustable to accommodate differing goal sizes. For example, some typical goal dimensions for the game of soccer are 5 feet by 10 feet, 6 feet by 12 feet, 7 feet by 21 feet, and 8 feet by 24 feet, with the various dimensions corresponding to differing levels or age groups. The goal width is defined by the horizontal spacing of the goal poles and the goal height is defined by the vertical height of the cross-bar member. Many prior art sports goal designs are not adjustable in nature and only correlate to a specific goal size.

Accordingly, there is a need in the art for a relatively light weight, portable, sports goal which is readily assembled and disassembled and may be adjusted to accommodate a variety of goal sizes.

SUMMARY OF THE INVENTION

In accordance with the present invention, there is provided a portable sports goal which is readily assembled and disassembled for use on a playing field. The sports goal is provided with a pair of pole stakes having respective support collars. The sports goal is further provided with a pair of goal poles which have respective first and second ends. The first ends of the goal poles have respective hollow inner portions which are sized and configured to receive a respective support collar of the poles stakes. The sports goal is further provided with a pair of line stakes and a pair of pole lines which are connectable between the respective line stakes and the second ends of the goal poles, for supporting the goal poles. The sports goal is further provided with an elastic cross-bar member which is attachable to the second ends of the goal poles. The pole stakes act to laterally support the goal poles in a vertical position when the goal poles are engaged with the support collars and the pole stakes are vertically driven into the playing field.

Preferably, the sports goal is provided with a net which is attachable to the cross-bar member and the goal poles. Cross-bar fasteners are provided for attaching the net to the cross-bar member. The cross-bar fasteners are rings. Goal pole fasteners are provided for attaching the net to the goal poles. The goal pole fasteners are straps. In addition, the elastic cross-bar member is formed of a bungee cord.

The pole lines are provided with an adjustment fastener for length adjustment of the respective pole line. The length adjustment adjusts the tightness of the pole line.

In practice, the goal poles are expected to experience repeated lateral force impacts which are perpendicular to the axis defined by the goal poles, i.e., perpendicular to the goal line. For example, these force impacts occur when a soccer ball hits the goal poles, the cross-bar member, the poles lines or the net. These force impacts undesirable tend to displace the goal poles from their vertical alignment. The present invention, however, incorporates the use of two resistive/restorative forces which act upon the goal poles to maintain their vertical alignment, beyond the anchoring support provided by the pole stakes. The first force is the result of the tension within the elastic cross-bar member which is stretched between the two goal poles. The second force is created by the two taught pole lines. As such, if either of the two goal poles is forced to move from its vertical position the elastic resistance of the cross-bar member and the pole lines act in tandem to cause the goal pole to be pulled back in a direction of its original vertical position.

Further, the goal poles are formed of a first and a second tubular member, with the second tubular member being axially received by the first tubular member. Each goal pole is provided with a locking mechanism for locking the respective first and second tubular members relative to each other. The locking mechanism may be of a button snap type. Each first tubular member is provided with several axially spaced holes for engaging each locking mechanism. By locking the tubular members at various axial position, the length of the goal poles are adjusted. The length of the goal poles define the goal height.

Each pole stake is further provided with a support bar having a hole which is sized and configured to receive the respective pole stake therethrough. Preferably, the support bars are positioned such that they are axially aligned perpendicular to the goal line and extend in the direction of the net. The support bars serve two functions. First, the support bars provide additional lateral support to the goal poles to maintain them in an upright/vertical position. Second, the support bars offer vertical support to the pole stakes to mitigate against the attached support collars from sinking into the ground of the playing field. The support bars are preferably formed of elongated, rectangular substantially rigid members.

In addition, the present invention includes a method of assembly of the portable sports goal described above. The method begins with various above described structural elements. The pole stakes are substantially vertically driven into the playing field. The distance between the pole stakes corresponding to a desired goal width. The line stakes are driven into the playing field. The line stakes are aligned with the pole stakes with the pole stakes disposed between the line stakes. One of the goal poles is erected by engaging the inner portion of the first end of the goal pole with one of the support collars of the pole stakes. The pole line which is attached to the erected goal pole is attached to nearest line stake. The elastic cross-member is stretch by moving the other goal pole in a direction toward the other pole stake. The other goal pole is erected by engaging the inner portion of the first end of the goal pole with the other support collar of the other pole stake. The other pole line is connected to the other line stake. The tightness of the pole lines are adjusted such that the pole lines are taught and the goal poles are in a substantially vertical position.

In addition, the goal poles are adjustable in length and method of the present invention further includes adjusting the length of each goal pole to correspond to a desired goal height. Further, the pole stakes are further provided with respective support bars and the method of the present invention further includes the step of aligning the support bars perpendicular to the axis defined by the pole stakes.

The portable sports goal represents a significant advance in the art. Advantageously, the sports goal of the present invention is relatively light in weight. Unlike many more permanent type sports goals, the present sports goal of the present invention does not use any heavy weights to anchor the goal poles. The present invention does not use structural elements such as heavy metal goal poles, cross-bar and supporting members. In addition, the sport goal of the present invention is compact. The goal poles are preferably formed to be collapsible. Importantly, the elastic cross-bar member is not a rigid structure and may be formed of a bungee cord, for example. It is contemplated that the entire sports goal could be transported in a large hand-carried sports bag. Thus, because of its relative light weight and compact nature the sports goal of the present invention is truly portable.

Moreover, the sports goal may be readily anchored in place. This is accomplished through the use of the pole stakes. The pole stakes may be easily driven into the playing field by simply stepping on them if the ground is soft enough or by hammering them down with any suitable device, such as a hammer or mallet which may be transported in the same sports bag used to transport the sport goal. Because the present sport goal may be anchored into place, it does not suffer from being displaced from its desired position during use.

In addition, the sports goal of the present invention may be adjusted to accommodate a variety of goal sizes. This is important because the depending upon the particular sports game and level to be played differing goal sizes may be desired. Adjustment of the goal size is facilitated by the extendable/retractable nature of the goal poles and the elastic nature of the cross-bar member.

Based upon the foregoing, the present invention represents a substantial advance in the art.

BRIEF DESCRIPTION OF THE DRAWINGS

These, as well as other features of the present invention, will become more apparent upon reference to the drawings wherein:

FIG. 1 is a perspective view of a portable sports goal constructed in accordance with the present invention;

FIG. 2 is an exploded view of a goal pole and pole stake of the sports goal depicted in FIG. 1;

FIG. 3 is a partial cross-sectional view of the first end of a goal pole and associated pole stake as seen along axis 3—3 of FIG. 1;

DETAILED DESCRIPTION OF THE PREFERRED EMBODIMENT

Figures 4, 5:
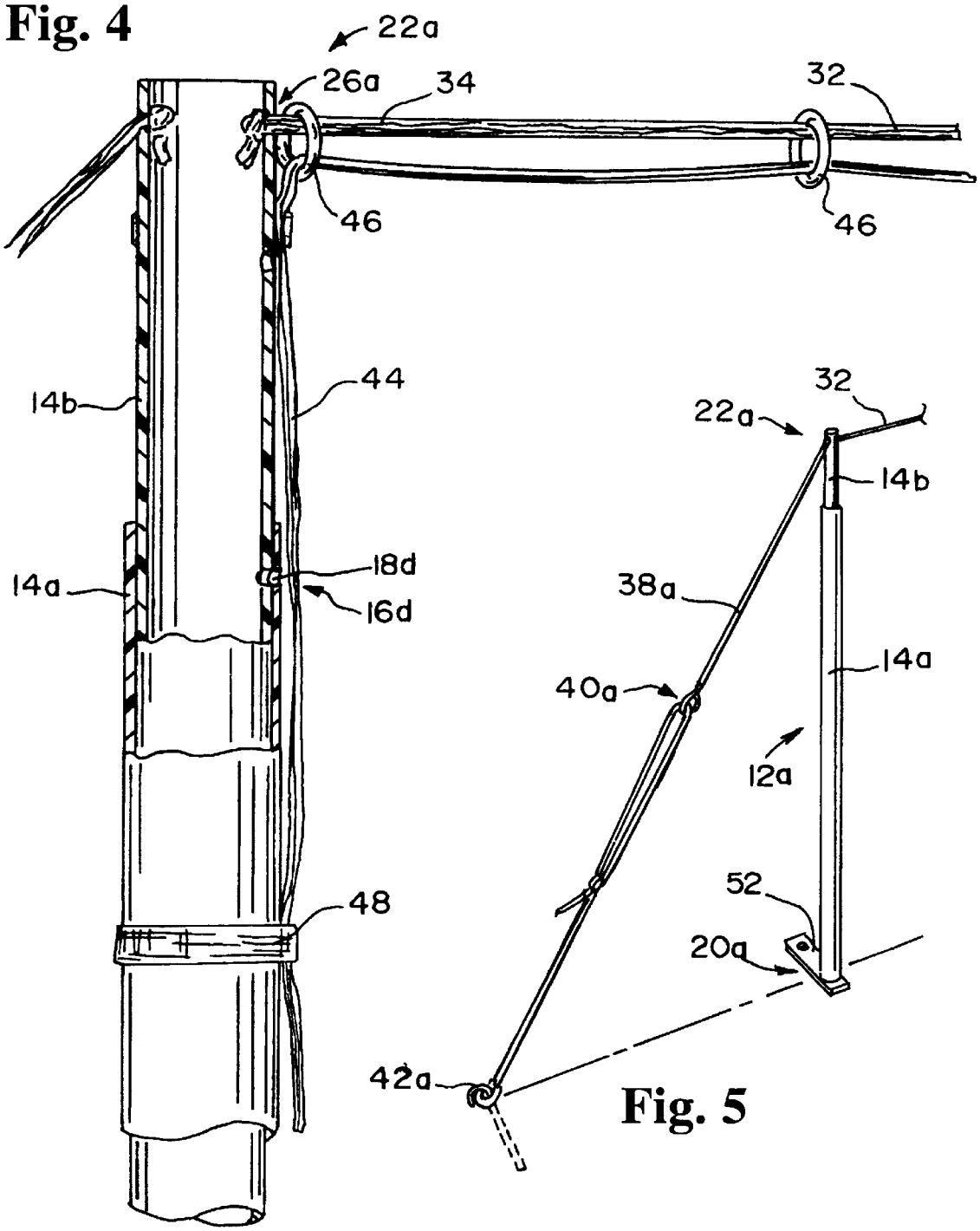
FIG. 4 is a partial cross-sectional view of the second end of a goal pole as seen along axis 4—4 of FIG. 1.
FIG. 5 is a enlarged view of a pole line of the sports goal depicted in FIG. 1.

Referring now to the drawings wherein the showings are for purposes of illustrating of a preferred embodiment of the present invention only, and not for purposes of limiting the same, FIGS. 1–6 illustrate a portable sports goal 10 constructed in accordance with the present invention. As will be described in more detail below, the portable sports goal 10 is designed to be readily assembled and disassembled.

Referring now to FIG. 1, in accordance with the present invention, there is provided a portable sports goal 10 for use on a playing field. The sports goal 10 is provided with a pair of adjustable goal poles 12*a*, 12*b*. The goal poles 12*a*, 12*b* are preferably formed of at least two telescoping tubular members 14. Each of the goal poles 12*a*, 12*b* has a first end 20*a*, 20*b* and a second end 22*a*, 22*b*. The sports goal 10 is further provided with a pair of pole stakes 28*a*, 28*b* which are formed to be driven into the playing field. Each of the pole stakes 28*a*, 28*b* has a support collar 30*a*, 30*b*. The first ends 20*a*, 20*b* of the poles 12*a*, 12*b* are formed to receive and fit over the support collars 30*a*, 30*b* of the pole stakes 28*a*, 28*b*. In addition, the sports goal 10 is provided with an elastic cross-bar member 32 which connects the respective second ends 22*a*, 22*b* of the goal poles 12*a*, 12*b*. The elastic cross-bar member 32 is configured to be horizontally aligned. A pair of pole lines 38*a*, 38*b* are also connected to the second ends 22*a*, 22*b* of the goal poles 12*a*, 12*b* for maintaining the goal poles 12*a*, 12*b* in a substantially upright/vertical position. The sports goal 10 is provided with a net 44 which is sized and configured to correspond to a predetermined goal width. The net 44 is attached to the elastic cross-bar member 32 via several cross-bar fasteners 46 and the net 44 is attached to the goal poles 22*a*, 22*b* via several pole fasteners 48. In addition, at least two net stakes 50 are provided to secure the bottom portion of the net to the playing field. Thus, the pair of goal poles 12*a*, 12*b*, the elastic cross-bar member 32 and the field of play collectively define a rectangular goal area through which a sports ball (not shown) may be shot through and subsequently caught by the net 44.

Referring now to FIG. 2, an exploded view of a goal pole 12 and its associated pole stake 28 is depicted. As can be seen, in this particular embodiment, the goal pole 28 is formed of two tubular members 14*a*, 14*b*. The tubular member 14*a* is formed to slidably receive the tubular member 14*b*. The tubular members 14*a*, 14*b* are formed such that tubular member 14*b* has a outer radial diameter less than the inner radial diameter of the other tubular member 14*a*. The length/height of the of goal pole 12*a*, 12*b* is adjusted by telescoping or indexing the tubular members 14*a*, 14*b* within one another. The goal poles 12*a*, 12*b* may be formed of more than two tubular members 14 and are preferably formed of a relatively light weight, sturdy material, such as PVC plastic tubing. The particular material used is chosen from those well known to one of ordinary skill in the art.

The tubular member 14*a* is provided with a several adjustment holes 16*a*, 16*b*, 16*c*, 16*d*. In addition, the tubular member 14*b* is provided with several locking members 18*a–d* which are formed to engage any of the adjustment holes 16*a–d* of tubular member 14*a*. Preferably, the locking members 18*a–d* are of a button snap type. As shown in FIG. 3, for example, the locking member 18*a* is engaged adjustment hole 18*a*. The spacing between the adjustment holes 16*a–d* and the locking members 18*a–d* correspond to desired goal pole lengths/heights. For example, some typical goal dimensions for the game of soccer are 5 feet by 10 feet, 6 feet by 12 feet, 7 feet by 21 feet, and 8 feet by 24 feet, with the various dimensions corresponding to differing age groups. The goal height is defined by the vertical height of the cross-bar member 32 as supported by the goal poles 12*a*, 12*b*. The particular spacing of the adjustment holes 16a-d and the locking members 18*a–d* is preselected to define a goal pole length/height that corresponds to a desired goal height, e.g., 5 feet, 6 feet, 7 feet, etc.

Referring now to FIG. 3, there is depicted a partial cross-sectional view of the first end 20*a* of the goal pole 12*a* and the associated pole stake 28*a* as seen along axis 33 of FIG. 1. The pole stake 28*a* is provided with a support collar 30*a* and the tubular member 14*a* is sized and configured to slidably receive the support collar 30*a*. As such, the inner radial diameter of the tubular member 14*a* is greater than the outer radial diameter of the support collar 30*a*. Preferably, the tubular member 14*a* snugly fits over and engages the support collar 30*a*. It is contemplated that the pole stakes 28*a*, 28*b* are vertically driven into a playing field. Thus, upon engagement or anchoring of the first ends 20*a*, 20*b* of the goal poles 12*a*, 12*b* with the support collars 30*a*, 30*b* of the pole stakes 28*a*, 28*b*, the goal poles 28*a*, 28*b* will assume a vertical alignment, such as depicted in FIG. 1. The placement of the pole stakes 28*a*, 28*b* with the engaged goal poles 12*a*, 12*b* define the goal line.

As mentioned above, the sports goal 10 is provided with a pair of pole lines 38*a*, 38*b* for maintaining the goal poles 12*a*, 12*b* in a substantially upright/vertical position. Referring now to FIG. 4, there is depicted a partial cross-sectional view of the second end 22*a* of the goal pole 12*a* as seen along axis 4–4 of FIG. 1. A first attachment hole 24 is located at the second end 22*a* of the goal pole 12*a*. The pole line 38*a* is attached to the second end 22*a* via the first attachment hole 24. The pole line 38*b* is similarly attached to its associated goal pole 12*b*. Referring now to FIG. 5, there is depicted an enlarged view of the pole line 38*a* as seen in FIG. 1. While one end of pole line 38*a* is attached to the second end 20*a* of the goal pole 12*a*, the other end of the pole line 38*a* is attached to the line stake 42*a*. The line stakes 42*a*, 42*b* are driven into a playing field and are aligned with the first ends 20*a*, 20*b* of the goal poles 12*a*, 12*b* are seen in FIG. 1. The line stakes 42*a*, 42*b* may be staked into the playing field at several feet outside of the goal poles 12*a*, 12*b*, five feet for example. In addition, the pole lines 38*a*, 38*b* are provided with respective adjustment fasteners 40*a*, 40*b*. The adjustment fasteners 40*a*, 40*b* facilitate adjustment of the length and tightness of the pole lines 38*a*, 38*b*. Adjustment of the length and tightness of the pole lines 38*a*, 38*b* facilitates vertical alignment of the goal poles 12*a*, 12*b*. Preferably, the pole lines 38*a*, 38*b* are formed of a relatively non-stretchable or non-elastic material, such as nylon cord, for example. Other suitable materials are chosen from those materials well known to one of ordinary skill in the art.

As mentioned above, the sports goal 10 of the present invention is provided with an elastic cross-bar member 32. The elastic cross-bar member 32 is provided with a first end 34 and a second end 36. The first end 34 is connected to the second ends 22*a* of the goal pole 12*a* and the second end 36 is connected to the second end 22*b* of the goal pole 12*b*. The cross-bar member 32 is formed of an elastic material and may take the form of a bungee cord, for example. Other suitable materials are chosen from those well known to one of ordinary skill in the art. The elastic cross-bar member 32 is configured to be horizontally aligned when the attached goal poles 12*a*, 12*b* are secured/anchored to the pole stakes 28*a*, 28*b*. The cross-bar member 32 forms the topmost portion of the goal. Importantly, the goal poles 12*a*, 12*b* are spaced apart such that the cross-bar member 32 is stretched taught.

In addition, the sports goal 10 is further provided with a net 44. The net 44 is attached to the elastic cross-bar member 32 via several cross-bar fasteners 46. Preferably, the cross-bar fasteners 46 slidably engage the elastic cross-bar member and take the form of rigid rings. The net 44 is also attached to the goal poles 12*a*, 12*b* via several pole fasteners 48. The pole fasteners 48 may take the form of resealable strips, cords, string, clamps for example. Other suitable material choices for the cross-bar fasteners 46 and the pole fasteners 48 are chosen from those well known to one of ordinary skill in the art.

In practice, the goal poles 12*a*, 12*b* are expected to experience repeated lateral force impacts which are perpendicular to the axis defined by the goal poles 12*a*, 12*b*, i.e., perpendicular to the goal line. For example, these force impacts occur when a soccer ball hits the goal poles 12*a*, 12*b*, the cross-bar member 32, the poles lines 38*a*, 38*b* and net 44. These force impacts undesirable tend to displace the goal poles 12*a*, 12*b* from their vertical alignment. The present invention, however, incorporates the use of two resistive/restorative forces which act upon the goal poles 12*a*, 12*b* to maintain their vertical alignment, beyond the anchoring support provided by the pole stakes 28*a*, 28*b*. The first force is the result of the tension within the elastic cross-bar member 32 which is stretched between the two goal poles 12*a*, 12*b*. The second force is created by the two taught pole lines 38*a*, 38*b*. As such, if either of the two goal poles is forced to move from its vertical position the elastic resistance of the cross-bar member 32 and the pole lines 38*a*, 38*b* act in tandem to cause the goal pole 12*a*, 12*b* to be pulled back in a direction of its original vertical position.

Figure 6:
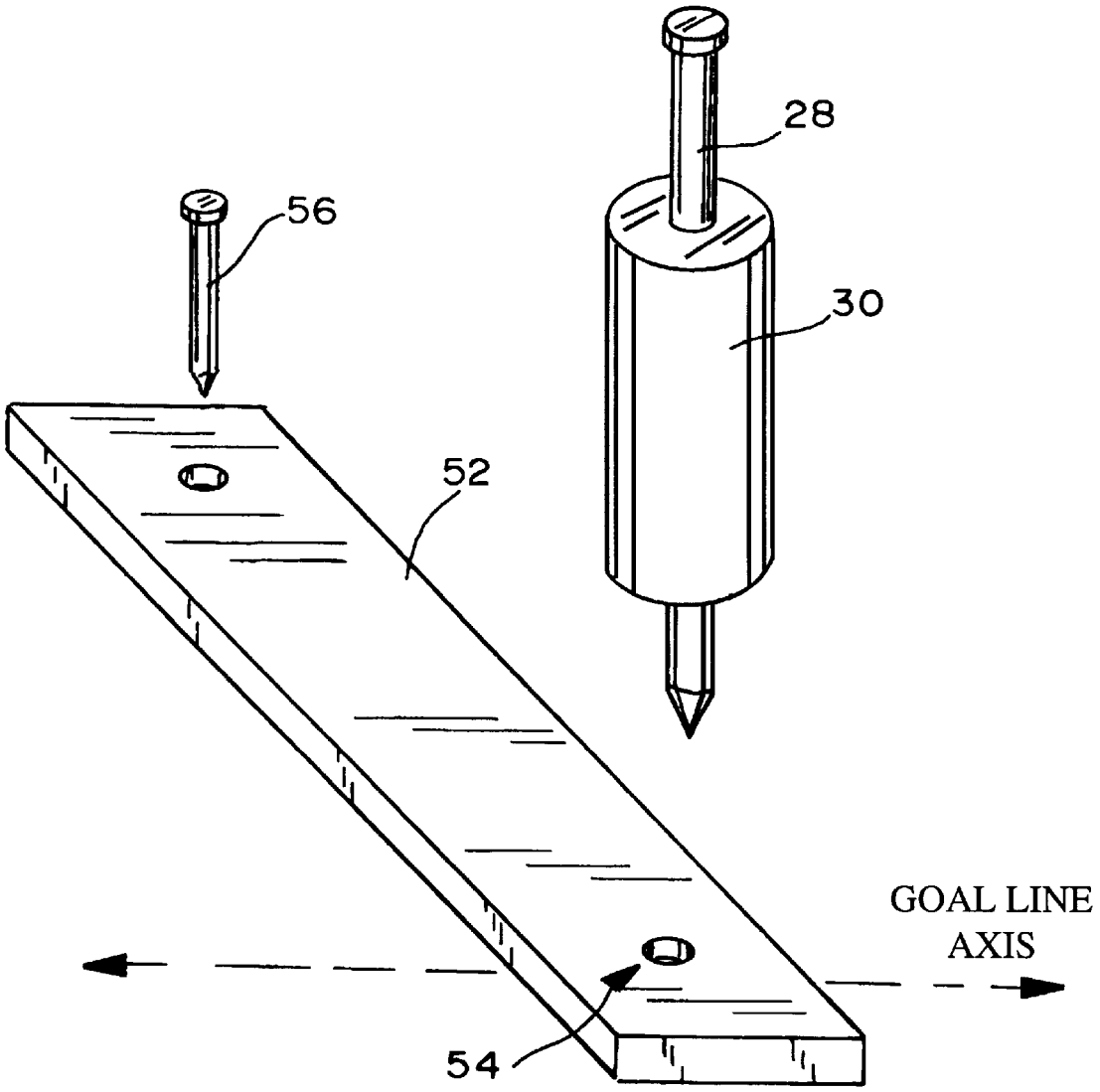
FIG. 6 is a perspective view of another embodiment of the pole stake used in the present invention.

Referring now to FIG. 6, the pole stakes 28*a*, 28*b*, are each provided with a support bar 52. Each support bar 52 is provided with a hole 54 through which the pole stakes 28*a*, 28*b* fit through with the support collars 30*a*, 30*b* disposed therebetween. It is contemplated that the support bar 52 permenently fixed to its associated support collar 30 thereby forming an integated piece. Preferably, the support bars 52 are positioned such that they are axially aligned perpendicular to the goal line and extend in the direction of the net 44. It is contemplated that the support bar 52 fixed into position relative to the playing field through the use of additional stakes, such as stake 56, or other suitable fasteners. The support bars 52 serve two functions. First, the support bars 52 provide additional lateral support to the goal poles 12*a*, 12*b* to maintain them in an upright/vertical position. Second, the support bars 52 offer vertical support to the pole stakes 28*a*, 28*b* to mitigate against the attached support collars 30*a*, 30*b* from sinking into the ground of the playing field. The support bars 52 are preferably formed of elongated, rectangular substantially rigid members. For example, the support bars 52 may be formed of metal or plastic and have dimension of a foot long, an inch and a half wide and a quarter inch thick with the hole 54 being positioned an inch and a half from one end. Other suitable material choices, geometries and dimensions may be selected from those well known to one of ordinary skill in the art.

In addition to the portable sports goal 10 described above, the present invention includes a method of assembling the same. The method of assembly begins with the initial step of providing the structural elements of the sports goal 10 as above-described and taking them to a playing field. Preferably, the elastic cross-bar member 32 is pre-attached to the respective second ends 22*a*, 22*b* of the goal poles 12*a*, 12*b*. In addition, the net 44 is preferably pre-attached to the cross-bar member 32 via the cross-bar fasteners 46*a*, 46*b*. In addition, the net 44 is sized and configured so as to correspond to a predetermined the goal width (e. g. , 10 ft. , 12 ft. , 21 ft. , etc. ) Further, the pole lines 38*a*, 38*b* are preferably preattached to the second end 22*a*, 22*b* of the goal poles 12*a*, 12*b*.

Next, the pole stakes 28*a*, 28*b* are each sequentially inserted through their respective the support collars 30*a*, 30*b* and the holes 54*a*, 54*b* of the support bars 52*a*, 52*b*. The pole stakes 28*a*, 28*b* are vertically driven into the playing field with the support bars 52 directly contacting the playing field and the support collars 30*a*, 30*b* resting on top of the support bars 52. Where the playing field is sufficiently soft, it is contemplated that the pole stakes 28*a*, 28*b* may be driven into the playing field by merely stepping on top of them. The pole stakes 28*a*, 28*b* may be driven into the playing field, however, through other ways such as hammering, for example. As mentioned above, the net 44 is preferably sized and configured to correspond to a predetermined goal width. The spacing between where the pole stakes 38*a*, 38*b* are driven into the field of play corresponds to the predetermined goal width.

The length of the goal poles 12*a*, 12*b* are adjusted to correspond to a desired goal height. As described above, the goal poles 12*a*, 12*b* are formed of at least two telescoping tubular members 14*a*, 14*b* with the tubular member 14*a* having several adjustment holes 16*a–d* and the tubular member 14*b* having several locking members 18*a–d*. The tubular member 14*b* is slid within the tubular member 14*a* to index the locking members 18*a–d* to desired adjustment holes 16*a–d* which correspond to a given goal pole length.

The line stakes 42*a*, 42*b* are next driven into the playing field. The line stakes 42*a*, 42*b* are driven into the playing field so as to be substantially aligned with the goal poles 12*a*, 12*b*. Preferably, the line stake 42*a* is several feet away from the goal pole 12*a* and line stake 42*b* is several feet away from other goal pole 12*b*, with the goal poles 12*a*, 12*b* being in between the line stakes 42*a*, 42*b*. Preferably, the line stakes 42*a*, 42*b* are driven into the playing field at a slight angle, such as thirty degrees, such that they point in a direction towards the nearest goal pole 12*a*, 12*b*.

The goal pole 12*a* is vertically erected by fitting the first end 20*a* of the goal pole 12*a* over the support collar 30*a* of the pole stake 28*a*. The pole line 38*a* is adjusted in length via the adjustment fastener 40*a* so as to permit attachment of the pole line 38*a* to the line stake 42*a*. The pole line 38*a* is attached to the line stake 42*a*. The pole line 38*a* is further adjusted in length such that it is taught and the goal pole 12*a* is vertical. The other goal pole 12*b* with the attached net 44 is next taken in a direction of the goal pole 12*a* with the elastic cross-bar member 32 becoming tightened in the process. The goal pole 12*b* is vertically erected by fitting the first end 20*b* of the goal pole 12*b* over the support collar 30*b* of the pole stake 28*b*. The pole line 38*b* is adjusted in length via the adjustment fastener 40*b* so as to permit attachment of the pole 38*b* to the line stake 42*b*. The pole line 38*b* is attached to the line stake 42*b*. The pole line 38*a* is further adjusted in length such that it is taught and the goal pole 12*a* is vertical. It may be necessary to finally adjust both of the pole lines 38*a*, 38*b* such that the goal poles 12*a*, 12*b* are vertical and perpendicular to the playing field. The pole fasteners 48 are used to secure the net to the goal poles 12*a*, 12*b*. Finally, the net stakes 50 are driven into the playing field so as to secure the net 44 to the playing field.

Additional modification and improvements of the present invention may also be apparent to those of ordinary skill in the art. Thus, the particular combination of parts described and illustrated herein is intended to represent only one embodiment of the present invention, and is not intended to serve as limitation of alternative devices within the spirit and scope of the invention.

What is claimed is:

1. A portable sports goal which is readily assembled and disassembled for use on a playing field, the sports goal comprising:

a pair of pole stakes having respective support collars, the pole stakes being formed to be driven into the playing field;

a pair of goal poles having respective first and second ends, the first ends having respective hollow inner portions which are sized and configured to receive the respective support collars for vertically positioning the goal poles;

a pair of line stakes formed to be driven into the playing field;

a pair of pole lines connectable between the respective line stakes and the second ends of the goal poles, for supporting the goal poles;

an elastic cross-bar member attachable in tension to the second ends of the goal poles; and wherein the pole lines and the elastic cross-bar member cooperatively act to exert pulling forces against the second ends of the goal poles for maintaining the goal poles in a vertical position.

2. The sports goal of claim 1 further comprising a net which is attachable to the cross-bar member and the goal poles.

3. The sports goal of claim 2 further comprising cross-bar fasteners for attaching the net to the cross-bar member.

4. The sports goal of claim 3 wherein the cross-bar fasteners are rings.

5. The sports goal of claim 2 further comprising goal pole fasteners for attaching the net to the goal poles.

6. The sports goal of claim 5 wherein the goal pole fasteners are straps.

7. The sports goal of claim 1 wherein the cross-bar member is formed of a bungee cord.

8. The sports goal of claim 1 wherein each of the goal poles are formed of a first and a second tubular member, with the second tubular member being axially received by the first tubular member.

9. The sports goal of claim 8 wherein each goal pole having a locking mechanism for locking the respective first and second tubular members relative to each other.

10. The sports goal of claim 9 wherein each locking mechanism is a button snap type.

11. The sport goal of claim 9 wherein each first tubular member having several axially spaced holes for engaging each locking mechanism.

12. The sports goal of claim 1 wherein each pole line having an adjustment fastener for length adjustment of the respective pole line.

13. The sports goal of claim 1 wherein each pole stake further having a support bar having a hole which is sized and configured to receive the pole stake therethrough.

14. The sports goal of claim 13 wherein each support bar being rectangular.

15. The sports goal of claim 1 wherein the pole stakes are to be driven into the playing field thereby defining a horizontal axis therebetween, the line stakes are formed to be driven into the playing field substantially along the horizontal axis with the poles stakes being disposed therebetween.

16. A method of assembly of a portable sports goal for use on a playing field, the method comprising the steps of:

(a) driving a pair of pole stakes into the playing field, the distance between the pole stakes corresponding to a desired goal width, the poles stakes each having a support collar;

(b) providing a pair of goal poles having respective first and second ends, the first ends having respective hollow inner portions which are sized and configured to receive the respective support collars of the poles stakes;

(c) attaching a pair of pole lines to each of the second ends of the goal poles;

(d) attaching an elastic cross-bar member between the second ends of the goal poles;

(e) driving a pair of line stakes into the playing field with the pole stakes disposed between the line stakes;

(f) erecting one of the goal poles by engaging the inner portion of the first end of the goal pole with the support collar of one of the pole stakes;

(g) attaching the pole line attached the erected goal pole to the nearest line stake;

(h) stretching the elastic cross-member in tension by moving the other goal pole in a direction toward the other pole stake;

(i) erecting the other goal pole by engaging the inner portion of the first end of the goal pole with the support collar of the other pole stake;

(j) attaching the other pole line to the other line stake; and (m) adjusting the tightness of the pole lines to position the goal poles in a substantially vertical position.

17. The method of claim 16 further comprising the steps of:

(n) providing a net;

(o) attaching the net to the cross-bar member and the goal poles.

18. The method of claim 16 wherein the goal poles are adjustable in length and step (b) further comprises adjusting the length of each goal pole to corrrespond to a desired goal height.

19. The method of claim 16 wherein the pole stakes each further having a respective support bar, the method further comprising the step of:

(n) aligning the support bars perpendicular to an axis defined by the pole stakes.

20. The method of claim 16 wherein the pair of pole stakes define a horizontal axis and in step (e) the line stakes are driven into the playing field along the horizontal axis.

* * * * *